United States Patent [19]

Miller

[11] Patent Number: 4,468,899

[45] Date of Patent: Sep. 4, 1984

[54] SKYLIGHT

[76] Inventor: Grady P. Miller, 2608 Holly Springs Dr., Germantown, Tenn. 38138

[21] Appl. No.: 446,448

[22] Filed: Dec. 3, 1982

[51] Int. Cl.[3] ..... E04D 1/36; E04B 7/18

[52] U.S. Cl. ..... 52/58; 52/200; 52/304; 52/398; 52/788

[58] Field of Search ..... 52/200, 202, 273, 398, 52/399, 788, 790, 72, 304, 58

[56] References Cited

U.S. PATENT DOCUMENTS

| | | | |
|---|---|---|---|
| 3,417,527 | 12/1968 | Kiekhaefer | 52/200 |
| 4,173,854 | 11/1979 | Wallerstein | 52/200 |
| 4,190,987 | 3/1980 | Naidus | 52/200 |
| 4,253,286 | 3/1981 | Katona | 52/790 |

FOREIGN PATENT DOCUMENTS

| | | | |
|---|---|---|---|
| 1114469 | 1/1954 | France | 52/304 |
| 2237026 | 3/1975 | France | 52/200 |
| 7312227 | 12/1974 | Netherlands | 52/200 |

*Primary Examiner*—John E. Murtagh
*Assistant Examiner*—Kathryn Ford
*Attorney, Agent, or Firm*—Walker & McKenzie

[57] ABSTRACT

A skylight for mounting on the roof structure of a building to allow sunlight and the like to enter the interior of the building. The skylight includes, in general, a frame for being mounted on the roof structure, a first transparent plate for being supported on an upper flange member of the frame, a second transparent plate for being supported from an intermediate flange member of the frame, a cap for securing the first plate to the frame, and a lock for locking the cap and frame together.

18 Claims, 8 Drawing Figures

SKYLIGHT

BACKGROUND OF THE INVENTION

1. Field of the Invention

The present invention relates to skylights for being installed on the roof structure of buildings and the like.

2. Description of the Prior Art

Heretofore, various skylights have been developed. The basic prior art skylight consists simply of a frame member for being attached to the roof structure of a building adjacent an opening through the roof structure into the interior of the building, and a substantially transparent member secured to the frame member for covering the opening through the roof structure in such a manner that sunlight and the like can pass therethrough into the interior of the building. The prior art does not disclose or suggest the present invention.

SUMMARY OF THE INVENTION

The present invention is directed toward improving prior skylights. The concept of the present invention is to provide a skylight comprising, in general, a frame means including a frame-body member, a lower flange member extending outwardly from the lower edge of the frame-body member, an upper flange member extending inwardly from the upper edge of the frame-body member, and an intermediate flange member extending inwardly from the frame-body member at a location intermediate the upper and lower edges of the frame-body member; a first transparent plate means for being supported on the upper flange member of the frame member; a second transparent plate means for being supported from the intermediate flange member of the frame means; anchor means for securing the second transparent plate means relative to the intermediate flange member of the frame means; cap means for securing the first transparent plate means relative to the upper flange member of the flange means, the cap means including a cap-body member and a flange member extending inwardly from the upper edge of the cap-body member; seal means for sealing the first transparent plate means relative to the cap means and the frame means, the seal means including a first seal member for being positioned generally between the first transparent plate means and the upper flange member of the frame means and including a second seal member for being positioned generally between the first transparent plate means and the flange member of the cap means; and lock means for locking the frame means and the cap means together.

DESCRIPTION OF THE PREFERRED EMBODIMENT

Figure 3:
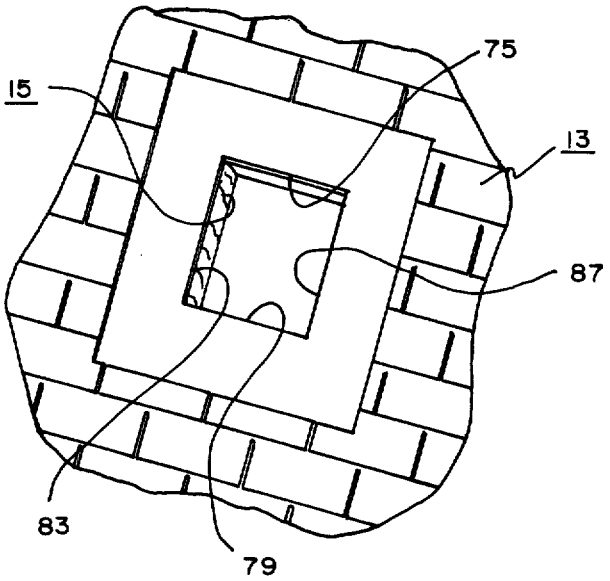
FIG. 3 is a somewhat diagrammatic perspective view of a roof structure prepared to receive the skylight of the present invention.
Figure 4:
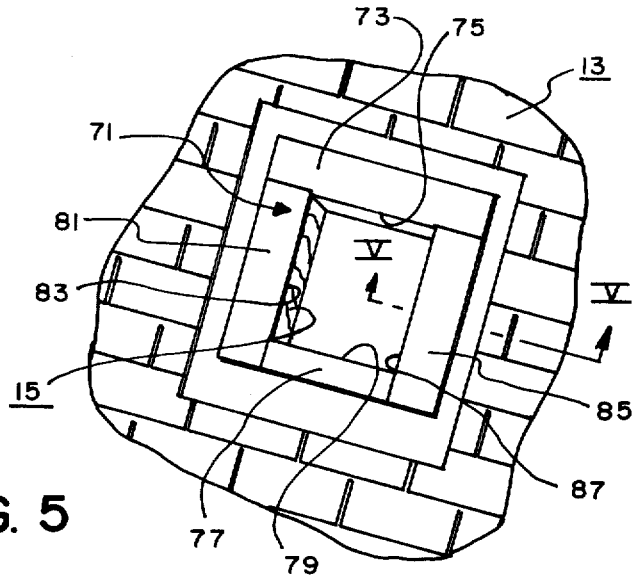
FIG. 4 is a view somewhat similar to FIG. 3 but showing portions of the skylight of the present invention mounted on the roof structure.
Figure 5:
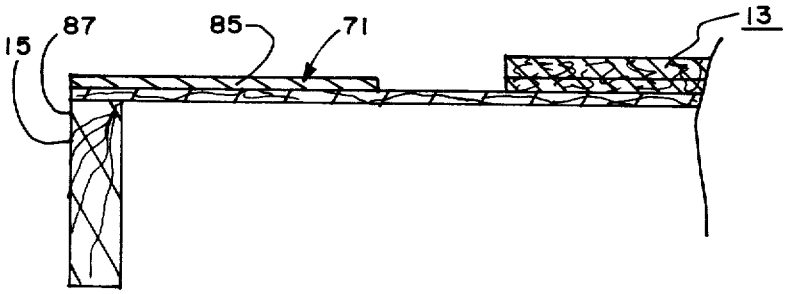
FIG. 5 is an enlarged sectional view as taken on line V—V of FIG. 4.

The skylight 11 of the present invention is for use in the typical manner to allow sunlight to pass through the roof structure 13 of a building. The roof structure 13 preferably slopes downwardly at an angle as clearly indicated in FIGS. 3 and 4. The skylight 11 is for being positioned over an opening 15 through the roof structure 13.

Figure 1:
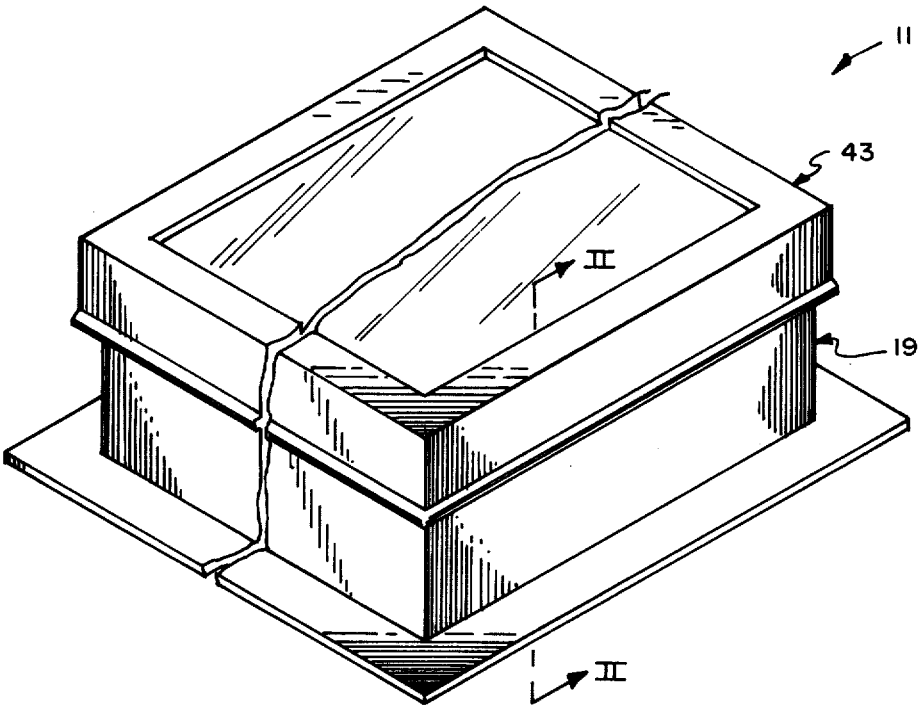
FIG. 1 is a perspective view of the basic components of the skylight of the present invention.
Figure 2:
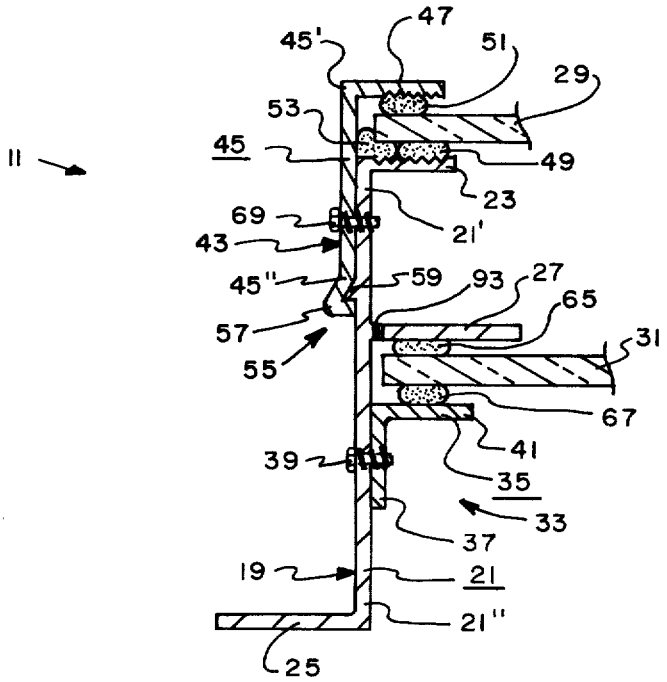
FIG. 2 is an enlarged sectional view as taken on line II—II of FIG. 1.
Figure 6:
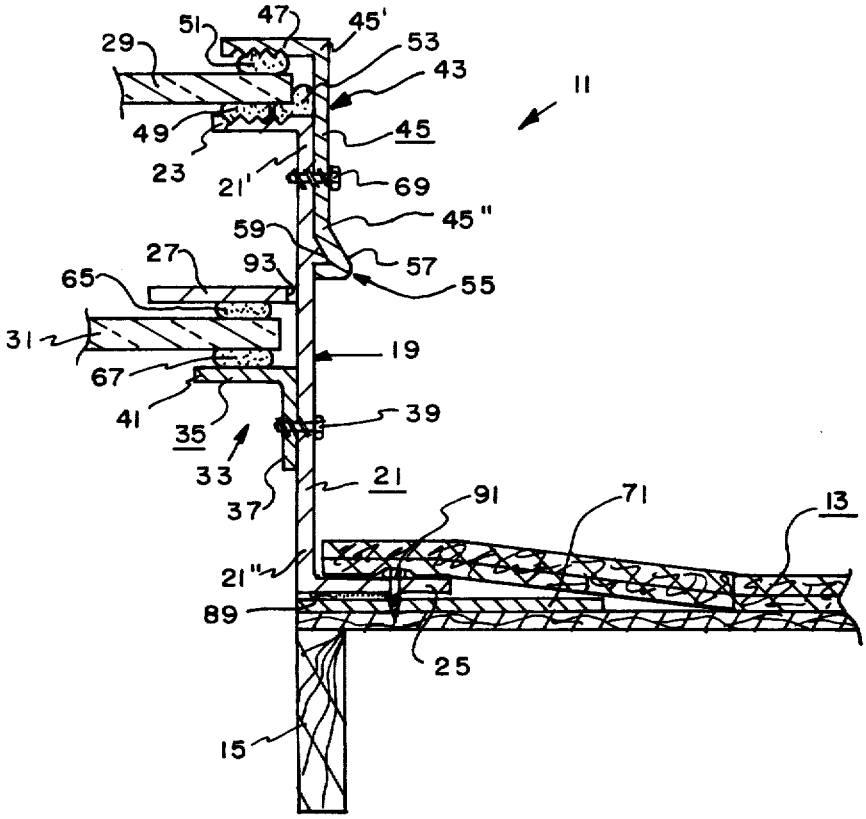
FIG. 6 is a sectional view similar to FIG. 5 but showing additional portions of the skylight of the present invention.

The skylight 11 includes a frame means 19 for being positioned on the roof structure 13 about the opening 15. The frame means 19 includes a frame-body member 21 having an upper edge 21' and a lower edge 21'' (see, in general, FIGS. 2 and 6). An upper flange member 23 extends inwardly from the upper edge 21' of the frame-body member 21. A lower flange member 25 extends outwardly from the lower edge 21'' of the frame-body member 21. An intermediate flange member 27 extends inwardly from the frame-body member 21 at a location intermediate the upper and lower edges 21', 21'' thereof. The frame-body member 21 and the various flange members 23, 25, 27 may be integrally constructed as a one-piece unit out of extruded aluminum or the like in any manner apparent to those skilled in the art. The frame means 19 may be constructed in various sizes and shapes to fit about the opening 15 in the roof structure 13. Typically, the opening 15 will be square or rectangular and the frame means 19 will include four elongated members joined to one another at opposite ends by being welded or the like to form a substantially open square or rectangular framework.

The skylight 11 includes a first transparent plate means 29 for being supported on the upper flange member 23 of the frame means 19 and includes a second transparent plate means 31 for being supported from the intermediate flange member 27 of the frame means 19. The first and second transparent plate means 29, 31 preferably consists of tempered safety glass having a shape substantially the same as the square or rectangular framework defined by the frame means 19 to coact with the frame means 19 to cover the opening 15 through the roof structure 13.

The skylight 11 preferably includes anchor means 33 for securing the second transparent plate means 31 relative to the intermediate flange member 27 of the frame means 19. The anchor means 33 may consist merely of a plurality of rigid, metal bracket members or the like for being attached to the frame-body member 21 of the frame means 19 in such a manner to secure the second transparent plate means 31 thereto. Thus, each of the bracket members may have a generally vertical body member 37 for being attached to the frame-body member 21 in any manner apparent to those skilled in the art such as by way of screws 39 which may pass through the frame-body member 21 and into an aperture 40 in the body member 37 (see, in general, FIGS. 2 and 6) and has a generally horizontal arm member 41 for extending beneath the second transparent plate means 31 thereby securing the second transparent plate means 31 between the intermediate flange member 27 and the arm member 41.

The skylight 11 includes a cap means 43 for securing the first transparent plate means 29 relative to the upper flange member 23 of the frame means 19. The cap means 43 includes a cap-body member 45 having an upper edge 45' and a lower edge 45". A flange member 47 extends inwardly from the upper edge 45' of the cap-body member 45. The cap-body member 45 and flange member 47 may be integrally constructed as a one-piece unit out of extruded aluminum or the like. The cap means 43 has the same general shape as the open framework defined by the frame means 19 and thus typically includes four sides joined to one another at opposite ends by welding or the like to define a generally opened square or rectangle.

The skylight 11 includes seal means for sealing the first transparent plate means 29 relative to the cap means 43 and the frame means 19. The seal means includes a first seal member 49 for being positioned generally between the first transparent plate means 29 and the upper flange member 23 of the frame means 19. The seal means also includes a second seal member 51 for being positioned generally between the first transparent plate means 29 and the flange member 47 of the cap means 43. The seal means may include a third seal member 53 for being positioned generally between the first transparent plate means 29 and the cap-body member 45 of the cap means 43 and the upper flange member of the frame means 19. The first and second seal members 49, 51 may consist simply of elongated lengths of butyl tape or the like well-known to those skilled in the art for extending around the entire periphery 29. The third seal means 53 may consist simply of a continuous length of butyl caulk or the like well-known to those skilled in the art for extending around the entire periphery of the junction between the first transparent plate means 29, the cap-body member 45 of the cap means 43 and the upper flange member 23 of the frame means 19.

Figure 7:
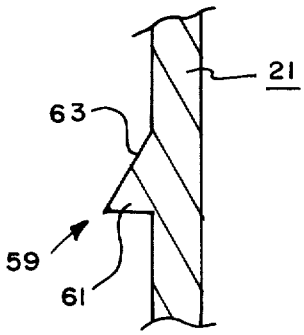
FIG. 7 is enlarged sectional view of a portion of the frame means of the skylight of the present invention.
Figure 8:
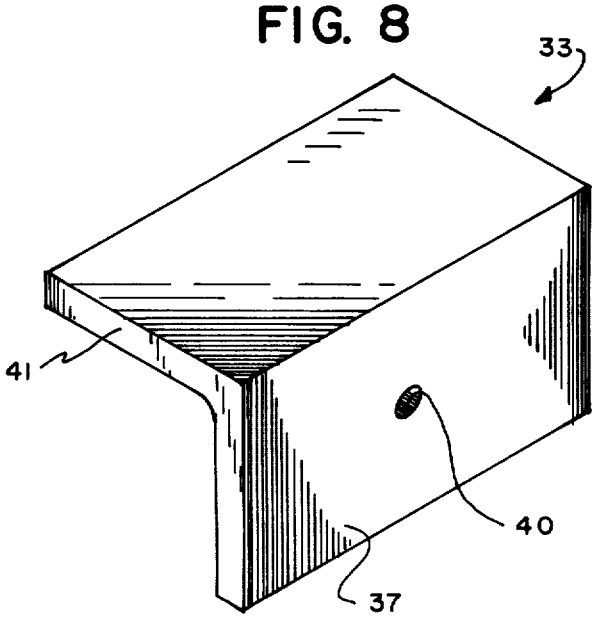
FIG. 8 is a perspective view of a bracket member of the anchor means of the skylight of the present invention.

The skylight 11 includes a lock means 55 for locking the frame means 19 and cap means 43 together. The lock means 55 preferably holds the frame means 19 and cap means 43 together in such a manner so that the first and second seal members 49, 51 are held under compression. The lock means 55 preferably includes a first member 57 attached to the cap-body member 45 of the cap means 43 preferably at the lower edge 45" thereof, and preferably includes a second member 59 attached to the frame-body member 23 of the frame means 19 preferably intermediate the upper and lower edges 21', 21" thereof. The first and second members 57, 59 preferably coact with one another to lock the frame means 19 and cap means 43 together. The first member 57 is preferably a female member and the second member is preferably a male member. The first and second members 57, 59 thus preferably snap-fit together to securely lock the frame means 19 and cap means 43 together. The second member 59 preferably extends completely around the periphery of the frame means 19 and the first member 57 preferably extends completely around the periphery of the cap means 43. The second member 59 preferably has a substantially horizontal bottom face 61 and a normally downwardly angled top face 63 (see, in general, FIG. 7).

The skylight 11 preferably includes a second seal means for substantially sealing the second transparent plate means 31 relative to the frame means 19. The second seal means preferably includes a first seal member 65 for being positioned between the second transparent plate means 31 and the intermediate flange member 27 of the frame means 19. The first seal member 65 may consist of a length of butyl tape or the like well-known to those skilled in the art for extending around the entire periphery of the second transparent plate means 31. A plurality of cushioning member 67 such as butyl tape or the like well-known to those skilled in the art may be positioned between the arm members 41 of the bracket members 35 and the second transparent plate means 31 to provide cushioning therebetween. The spacing between the intermediate flange member 27 and the arm members 41 of the bracket members 35 is preferably of a distance to maintain the members 65, 67 under compression.

A plurality of screws 69 may be provided to aid the lock means 55 in securing the frame means 19 and cap means 43 together.

The skylight 11 preferably includes flashing means 71 for being positioned between the lower flange member 25 of the frame means 19 and the roof structure 13 onto which the skylight 11 is mounted. The flashing means 71 preferably includes a first flashing member 73 for being attached to the roof structure 13 adjacent a first side edge 75 of the opening 15, preferably includes a second flashing member 77 for being attached to the roof structure 13 adjacent a second side edge 79 of the opening 15, preferably includes a third flashing member 81 for being attached to the roof structure 13 adjacent a third side edge 83 of the opening 15 and includes a fourth flashing member 85 for being attached to the roof structure 13 adjacent a fourth side edge 87 of the opening 15. The flashing members 73, 77, 81, 85 are substantially wider than the lower flange member 25 of the frame means 19. The first flashing member 75 is preferably attached to the roof structure adjacent the upper side edge of the opening 15 and the second flashing member 77 is preferably attached to the roof structure 13 adjacent the lower side edge of the opening 15. The second flashing member 77 is preferably substantially narrower than the first, third and fourth flashing members 73, 81, 85.

The skylight 11 preferably includes a third seal means for being positioned between the lower flange member 25 of the frame means 19 and the flashing means 71 to seal the frame means 19 relative to the flashing means 71. The third seal means may consist simply of a seal member 89 of butyl caulking or the like well-known to those skilled in the art provided in a continuous line on the flashing members 73, 77, 81, 85 about the entire periphery of the opening 15 to form a continuous seal between the frame means 19 and the flashing means 71. Screws 91 or the like may be used to pass through the lower flange member 25 of the frame means 19 and into the roof structure 13 to securely attach the frame means 19 to the roof structure 13 and hold the seal member 89 under compression.

The frame means 19 preferably has one or more vent apertures 93 extending through the intermediate flange member 27 substantially adjacent the frame-body member 21 for allowing ventilation between the area intermediate the first and second transparent plate means 29, 31 and the area below the second transparent plate means 31 (i.e., the interior of the building).

It will be appreciated by those skilled in the art that the skylight 11 can be constructed of various materials in various sizes and shapes to fit various specific needs and conditions. Although the invention has been described and illustrated with respect to a preferred embodiment thereof and a preferred use therefore, it is not to be so limited since changes and modifications can be made therein which are within the full intended scope of the invention.

I claim:

1. A skylight comprising:

(a) a frame means including a frame-body member having an upper edge and a lower edge, including a lower flange member extending outwardly from said lower edge of said frame-body member, including an upper flange member extending inwardly from said upper edge of said frame-body member, and including an intermediate flange member extending inwardly from said frame-body member at a location intermediate said upper and lower edges thereof;

(b) a first transparent plate means for being supported relative to said upper flange member of said frame means;

(c) a second transparent plate means for being supported relative to said intermediate flange member of said frame means;

(d) anchor means for securing said second transparent plate means relative to said intermediate flange member of said frame means;

(e) cap means for securing said first transparent plate means relative to said upper flange member of said frame means, said cap means including a cap-body member having an upper edge and a lower edge and including a flange member extending inwardly from said upper edge of said cap-body member;

(f) seal means for sealing said first transparent plate means relative to said cap means and said frame means, said seal means including a first seal member for being positioned generally between said first transparent plate means and said upper flange member of said frame means and including a second seal member for being positioned generally between said first transparent plate means and said flange member of said cap means; and (g) lock means for locking said frame means and said cap means together.

2. The skylight of claim 1 in which said seal means includes a third seal member for being positioned generally between said first transparent plate means and said cap-body member of said cap means and said upper flange member of said frame means.

3. The skylight of claim 1 in which said lock means holds said frame means and said cap means together in such a manner so that said first and second seal members are held under compression.

4. The skylight of claim 3 in which said lock means includes a first member attached to said cap-body member of said cap means, and includes a second member attached to said frame-body member of said frame means, said first and second members coacting with one another to lock said frame means and said cap means together.

5. The skylight of claim 4 in which said first member of said lock means is a female member and in which said second member of said lock means is a male member.

6. The skylight of claim 5 in which said male member and said female member snap-fit together to securely lock said frame means and said cap means together.

7. The skylight of claim 6 in which said male member extends completely around the periphery of said frame means, and in which said female member extends completely around the periphery of said cap means.

8. The skylight of claim 7 in which said male member has a substantially horizontal bottom face and an angled top face.

9. The skylight of claim 1 in which said anchor means includes a plurality of bracket members, each of said bracket members having a generally vertical body member for being attached to said frame-body member and having a generally horizontal arm member attached to said body member.

10. The skylight of claim 9 in which is included a second seal means for substantially sealing said second transparent plate means relative to said frame means, said second seal means including a first seal member for being positioned between said second transparent plate means and said intermediate flange member of said frame means.

11. The skylight of claim 10 in which is included a plurality of cushioning members for being positioned between said second transparent plate means and said arm members of said bracket members.

12. The skylight of claim 1 in which is included a plurality of screw members for securing said frame means and said cap means together.

13. The skylight of claim 9 in which is included a plurality of screw members for securing said bracket members of said anchor means to said frame means.

14. The skylight of claim 1 in which said skylight is mounted on roof structure and in which is included flashing means for being positioned between said lower flange member of said frame means and the roof structure onto which said skylight is mounted.

15. The skylight of claim 14 in which said frame means is substantially rectangular when viewed in plan; in which the roof structure is provided with a substantially rectangular opening over which said frame means is to be mounted; and in which said flashing means includes a first flashing member for being attached to the roof structure adjacent a first side edge of the opening through the roof structure, includes a second flashing member for being attached to the roof structure adjacent a second side edge of the opening through the roof structure, includes a third flashing member for being attached to the roof structure adjacent a third side edge of the opening through the roof structure, and includes a fourth flashing member for being attached to the roof structure adjacent a fourth side edge of the opening through the roof structure; said flashing members being substantially wider than said lower flange member of said frame means.

16. The skylight of claim 15 in which the roof structure slopes downwardly at an angle; in which the opening in the roof structure has an upper side edge and a lower side edge; in which said first flashing member is attached to the roof structure adjacent the upper side edge of the opening through the roof structure; in which the second flashing member is attached to the roof structure adjacent the lower side edge of the opening through the roof structure; and in which said second flashing member is substantially narrower than said first, third and fourth flashing members.

17. The skylight of claim 16 in which is included a third seal means for being positioned between said lower flange member of said frame means and said flashing members of said flashing means to seal said frame means relative to said flashing means.

18. The skylight of claim 1 in which said frame means has a vent aperture extend through said intermediate flange member substantially directly adjacent said frame-body member for allowing ventilation between the area intermediate said first and second transparent plate means and the area below said second transparent plate means.

* * * * *